US011311932B2

(12) United States Patent
Kim et al.

(10) Patent No.: US 11,311,932 B2
(45) Date of Patent: Apr. 26, 2022

(54) APPARATUS FOR MANUFACTURING CORE USING INORGANIC BINDER

(71) Applicants: HYUNDAI MOTOR COMPANY, Seoul (KR); KIA MOTORS CORPORATION, Seoul (KR); ABC Industries Co., Ltd., Ulsan (KR)

(72) Inventors: Kyoung Yong Kim, Hwaseong-si (KR); Jong Wook Kim, Suwon-si (KR); Seok Ha, Seoul (KR); Hyun Min Jeong, Namyangju-si (KR); Moo Kil Choi, Ulsan (KR)

(73) Assignees: HYUNDAI MOTOR COMPANY, Seoul (KR); KIA MOTORS CORPORATION, Seoul (KR); ABC Industries Co., Ltd., Ulsan (KR)

( * ) Notice: Subject to any disclaimer, the term of this patent is extended or adjusted under 35 U.S.C. 154(b) by 298 days.

(21) Appl. No.: 16/663,224

(22) Filed: Oct. 24, 2019

(65) Prior Publication Data

US 2020/0282453 A1 Sep. 10, 2020

(30) Foreign Application Priority Data

Mar. 8, 2019 (KR) ..... 10-2019-0027032

(51) Int. Cl.

| | |
|---|---|
| ***B22C 13/12*** | (2006.01) |
| ***B22C 19/04*** | (2006.01) |
| ***B22C 9/10*** | (2006.01) |

(52) U.S. Cl.

CPC ..... *B22C 13/12* (2013.01); *B22C 9/10* (2013.01); *B22C 19/04* (2013.01)

(58) Field of Classification Search

CPC ..... B22C 13/12; B22C 9/10; B22C 19/04

See application file for complete search history.

(56) References Cited

U.S. PATENT DOCUMENTS 4,196,768 A * 4/1980 Nakata ..... B22C 9/03 164/15
6,474,968 B1 * 11/2002 Mitamura ..... B29D 30/0601 425/40
8,082,975 B2 * 12/2011 Ide ..... B22C 9/12 164/159

* cited by examiner

*Primary Examiner* — Joseph S Del Sole
*Assistant Examiner* — John Robitaille
(74) *Attorney, Agent, or Firm* — Morgan, Lewis & Bockius LLP

(57) ABSTRACT

A core manufacturing apparatus using an inorganic binder includes a mulling sand feeder that supplies mulling sand comprising sand and the inorganic binder, a mold that receives the mulling sand from the mulling sand feeder and molds the mulling sand into a core, and a mold heating device that heats the mold. The mold includes an upper mold and a lower mold and has a plurality of cavities formed therein in which the mulling sand is deposited. The mold further includes an inner fluid channel through which fluid flows.

9 Claims, 9 Drawing Sheets

APPARATUS FOR MANUFACTURING CORE USING INORGANIC BINDER

CROSS-REFERENCE TO RELATED APPLICATION

This application claims the benefit of priority to Korean Patent Application No. 10-2019-0027032, filed in the Korean Intellectual Property Office on Mar. 8, 2019, the entire contents of which are incorporated herein by reference.

TECHNICAL FIELD

The present disclosure relates to an apparatus for manufacturing a core using an inorganic binder, and more particularly, relates to a core manufacturing apparatus using an inorganic binder that improves the productivity and fluidity of a core to manufacture a large outer core by using an inorganic binder.

BACKGROUND

Light alloy casting or cast iron casting uses a core made of sand in order to implement an inner or outer shape. FIG. 1 illustrates a core package in which small inner cores and large outer cores are assembled.

In general, a core is manufactured by preparing mulling sand by mixing sand and a binder, introducing the mulling sand into a mold, and then curing the binder by applying a thermal or chemical reaction to the mold.

Core manufacturing methods are classified depending on the types and curing methods of binders mulled with sand. Examples of the binders include organic binders, inorganic binders, and the like. The organic binders have been widely used due to the rapid curing speeds thereof. However, the organic binders may generate gases and odors in manufacturing and casting processes of cores and may therefore cause environmental pollution and deterioration in the qualities of castings.

In recent years, environmentally-friendly methods using odorless and fumeless inorganic binders as binders in manufacture of cores have been increasingly used. However, the methods using the inorganic binders fail to be applied to core packages using large outer cores because many heat sources and much time are required when the inorganic binders are used to mold the large outer cores. Accordingly, an improved technology for manufacturing a large outer core using an inorganic binder is required.

SUMMARY

The present disclosure has been made to solve the above-mentioned problems occurring in the prior art while advantages achieved by the prior art are maintained intact.

An aspect of the present disclosure provides a core manufacturing apparatus using an inorganic binder that reheats fluid introduced into a mold after being heated outside, thereby uniformly maintaining the temperatures of a plurality of cavities in the mold.

Another aspect of the present disclosure provides a core manufacturing apparatus using an inorganic binder that directly injects hot air into a central portion of a core that is to be solidified, thereby reducing core sintering time, which in turn reduces core manufacturing cycle.

Another aspect of the present disclosure provides a core manufacturing apparatus using an inorganic binder that is able to ensure the productivity and quality of a large outer core even in the case of manufacturing the large outer core using an inorganic binder.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an apparatus for manufacturing a core using an inorganic binder includes a mulling sand feeder that supplies mulling sand prepared by mulling sand and the inorganic binder, a mold that receives the mulling sand from the mulling sand feeder and molds the mulling sand into the core, and a mold heating device that heats the mold. The mold includes an upper mold and a lower mold and has a plurality of cavities formed therein in which the mulling sand is deposited. The mold further includes an inner fluid channel through which fluid flows. The mold heating device includes: a heating line that is provided outside the mold and that connects to the inner fluid channel to allow the fluid to flow in or out of the inner fluid channel and to circulate the fluid through the inner fluid channel; a first heater that is connected to the heating line and that heats the fluid that is released from the mold to the heating line and then introduced into the mold again; and a second heater that is provided inside the mold so as to be adjacent to an intermediate position of the inner fluid channel and that heats the fluid flowing through the inner fluid channel.

The apparatus may further include a hot-air supply device that supplies hot air into the mold to solidify the mulling sand introduced into the mold. The mold may further include a blow hole penetrating through the upper mold to connect to the cavities such that the hot air from the hot-air supply device is injected into the mulling sand deposited in the cavities, and a hollow blow pin inserted through the upper mold to extend to a central portion of each cavity such that the supplied hot air is injected into a central portion of the core that is to be solidified.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, exemplary embodiments of the present disclosure will be described in detail with reference to the accompanying drawings.

The following embodiments are embodiments appropriate for the understanding of technical features of a core manufacturing apparatus using an inorganic binder according to the present disclosure. However, the present disclosure is not limited to the following embodiments, and technical features of the present disclosure are not restricted by the following embodiments. Furthermore, various changes and modifications can be made without departing from the spirit and scope of the present disclosure.

Figure 2:
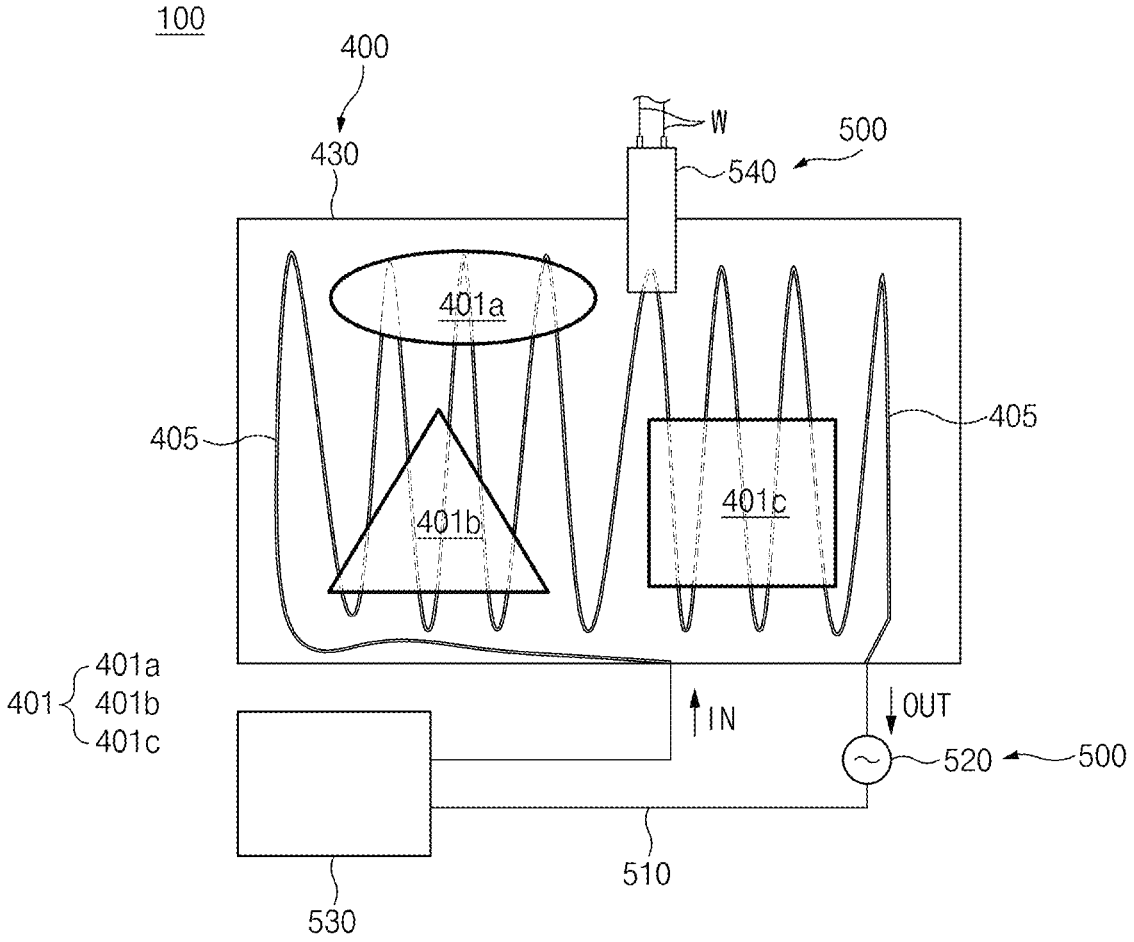
FIG. 2 is a view illustrating an embodiment of a core manufacturing apparatus using an inorganic binder according to the present disclosure, when viewed from above surface of a lower mold.
Figure 3:
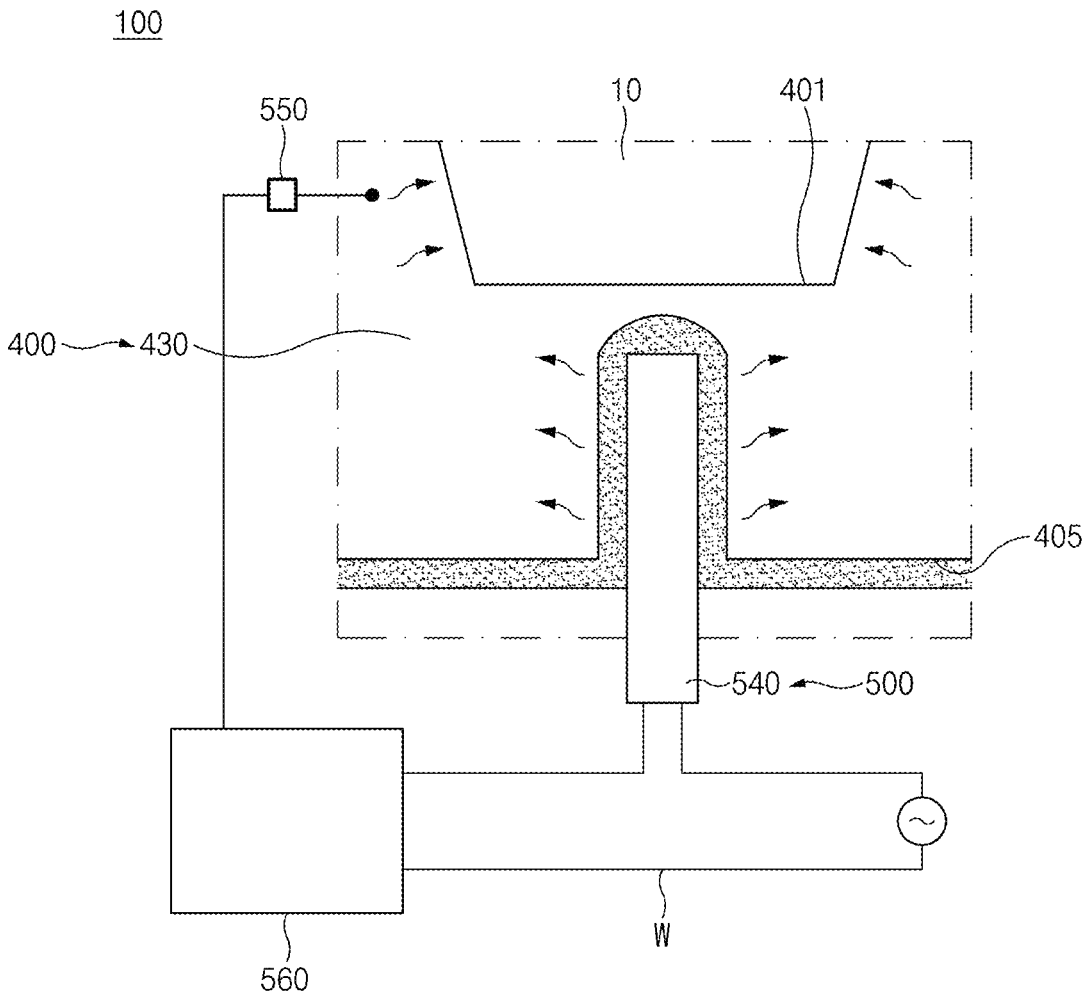
FIG. 3 is a schematic view illustrating a state in which a second heater applied to the present disclosure is installed in a mold.
Figure 4:
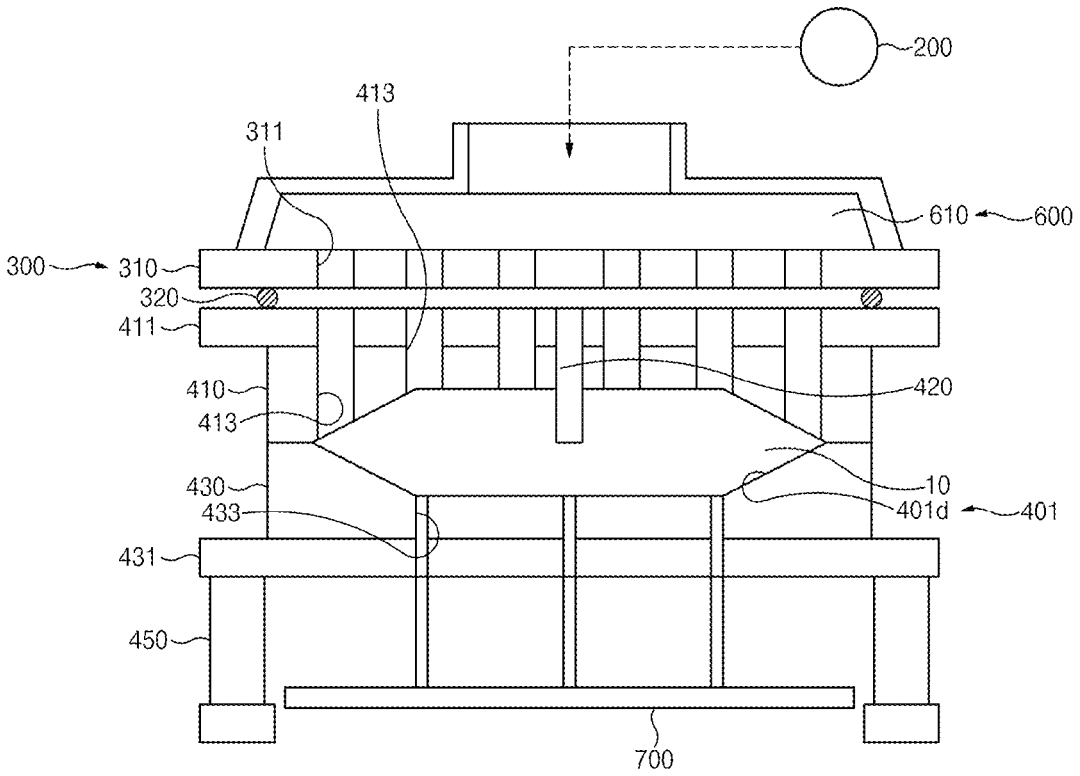
FIG. 4 is a sectional view illustrating the core manufacturing apparatus using the inorganic binder according to the present disclosure.

Referring to FIGS. 2 to 4, a core manufacturing apparatus 100 using an inorganic binder according to an embodiment of the present disclosure includes a mulling sand feeder 200 (not illustrated), a mold 400, and a mold heating device 500.

The mulling sand feeder 200 supplies mulling sand prepared by mulling sand and an inorganic binder. Inorganic binder may be an inorganic compound with silicon and sodium, for example, sodium silicate, but is not limited thereto. The mulling sand feeder 200 may include a kneading machine that mulls sand supplied and an inorganic binder, and the mulling sand prepared by the kneading machine may be supplied into the mold 400.

The mold 400 may receive the mulling sand from the mulling sand feeder 200 and may mold the mulling sand into a core. The mold 400 may include an upper mold 410 and a lower mold 430 and may have a plurality of cavities 401 formed therein in which the mulling sand is deposited. The mold 400 may further include an inner fluid channel 405 through which fluid flows.

Specifically, the upper mold 410 and the lower mold 430 may be engaged with each other to form the cavities 401 in which cores are molded (refer to FIG. 4). An upper base 411 may be provided on the top of the upper mold 410, and a lower base 431 may be provided on the bottom of the lower mold 430.

Figure 1:
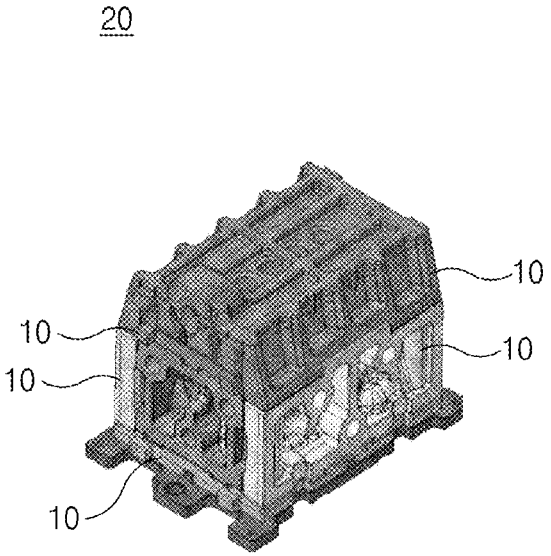
FIG. 1 is a view illustrating an example of a core package comprising a plurality of cores manufactured by the present disclosure.

The plurality of cavities 401 may receive the mulling sand therein, which is supplied by the mulling sand feeder 200. Examples of the cavities 401 are illustrated in FIG. 2. As in the embodiment illustrated in FIG. 2, a plurality of cavities 401*a*, 401*b*, and 401*c* may be formed in different shapes, and the one mold 400 may mold a plurality of cores 10 through the plurality of cavities 401*a*, 401*b*, and 401*c*. The plurality of cores 10 may be assembled to form a core package 20 as illustrated in FIG. 1. The shapes and number of cavities 401 may be diversely changed according to the core package 20 without being limited to the embodiment illustrated in FIG. 2.

The mold 400 may further include the inner fluid channel 405 through which the fluid flows.

Specifically, the inner fluid channel 405 may be formed in the mold 400 to allow the fluid to flow through the entire areas of the upper mold 410 and the lower mold 430. For example, the inner fluid channel 405 may be formed in a zigzag pattern and may include an inlet through which the fluid is introduced into the mold 400 from the outside and an outlet through which the fluid is released from the mold 400 to the outside. Here, the fluid may be oil heated by the mold heating device 500, but is not limited thereto.

Referring to FIGS. 2 and 3, the mold heating device 500 for heating the mold 400 includes a heating line 510, a first heater 520, and a second heater 540. The mold heating device 500 may preheat the mold 400 to an appropriate temperature and may maintain the mold 400 at a high temperature while the cores 10 are manufactured.

The heating line 510 is provided outside the mold 400. The heating line 510 connects to the inner fluid channel 405 to allow the fluid to flow in or out of the inner fluid channel 405 and to circulate the fluid throughout the inner fluid channel 405.

Specifically, in one embodiment, one end portion and an opposite end portion of the heating line 510 may be connected to the inlet and the outlet of the inner fluid channel 405, respectively, and the heating line 510 and the inner fluid channel 405 may form a closed circulation channel through which the fluid circulates.

The first heater 520 is connected to the heating line 510 and heats the fluid that is released from the mold 400 to the heating line 510 and then introduced into the mold 400 again. Specifically, in one embodiment, the first heater 520 may be located outside the mold 400 and connected to the heating line 510 and may heat the fluid outside the mold 400. The fluid heated by the first heater 520 may be supplied into the inner fluid channel 405 to transfer heat to the mold 400, and the fluid cooled while flowing through the mold 400 may be heated again while circulating through the heating line 510. Here, the first heater 520 may be, but is not limited to, an oil heater.

As described above, the fluid may be maintained at a predetermined temperature by the first heater 520 and the circulation lines of the heating line 510 and the inner fluid channel 405, and thus the temperature of the mold 400 may be maintained.

The mold heating device 500 of the present disclosure may further include the second heater 540. The second heater 540 is provided inside the mold 400. The second heater 540 is located adjacent to an intermediate position of the inner fluid channel 405 (i.e., located approximately middle way between the inlet and outlet of the inner fluid channel) and heats the fluid flowing through the inner fluid channel 405.

Specifically, in one embodiment, the inner fluid channel 405 may be formed around the areas where the plurality of cavities 401*a*, 401*b*, and 401*c* are formed to transfer heat to the plurality of cavities 401*a*, 401*b*, and 401*c*. When the fluid heated by the first heater 520 outside the mold 400 is cooled while it is in the mold 400, heat may not be appropriately transferred to the cavity 401*c* located between the intermediate position and the outlet of the inner fluid channel 405 compared to the plurality of cavities 401 located between the intermediate position and the inlet of the inner fluid channel. As a result, the temperature of the cavities 401 in the mold 400 varies depending on the location of the cavities 401.

The second heater 540 located around in the middle section of the mold 400 may reheat the fluid that is introduced into the mold 400 after being heated by the first heater 520. More specifically, in one embodiment, the second heater 540 may be mounted in at least one position among the positions between the plurality of cavities 401 and may transfer heat to the inner fluid channel 405. Furthermore, as in the embodiment illustrated in FIG. 2, the second heater 540 may be brought into contact with the inner fluid channel 405. However, without being limited thereto, various changes and modifications can be made as long as the fluid flowing through the inner fluid channel 405 is able to be heated.

For example, the second heater 540 may be an electric heater. However, the type of the second heater 540 is not limited thereto, and any heating member capable of being installed adjacent to the inner fluid channel 405 in the mold 400 to heat the fluid flowing through the inner fluid channel 405 may be used as the second heater 540.

The second heater 540 may transfer an appropriate amount of heat to the cavity 401*c* located between the intermediate position and the outlet of the inner fluid channel 405, thereby uniformly maintaining the temperature over the entire area in the mold 400 and thus minimizing the temperature difference between the cavities 401. Accordingly, the second heater 540 may serve to compensate for the temperature of the fluid in the mold 400, thereby improving the productivity of the cores.

The mold heating device 500 may further include a first controller 530 and a second controller 560.

Referring to FIG. 2, the first controller 530 may obtain the temperature of the fluid released from the inner fluid channel 405 to the heating line 510 and may control the first heater 520 based on the obtained temperature to heat the fluid before it is introduced into the inner fluid channel 405 again, to a preset temperature. The temperature of the fluid delivered to the inlet of the inner fluid channel 405 may be uniformly maintained by the first controller 530.

Referring to FIG. 3, based on the temperature received from a temperature sensor 550 that measures the temperature of an internal point adjacent to the second heater 540, the second controller 560 may control the second heater 540 to adjust the temperature of the internal point to reach a preset temperature. Here, FIG. 3 is a schematic view illustrating the second heater 540 of FIG. 2, and embodiments of the present disclosure are not limited thereto. Furthermore, the cavity 401 illustrated in FIG. 3 may be any one of the plurality of cavities 401*a*, 401*b*, and 401*c* illustrated in FIG. 2 and may be, for example, the cavity 401*c* located between the intermediate position and the outlet of the inner fluid channel 405.

The temperature sensor 550 may be installed inside or outside the mold 400 to measure the temperature at a position adjacent to the second heater 540. The second controller 560 may receive a signal from the temperature sensor 550 and may control the second heater 540 based on the temperature received from the temperature sensor 550. Accordingly, the fluid passing through the inner fluid channel 405 adjacent to the second heater 540 may be maintained at a predetermined temperature.

Figure 5:
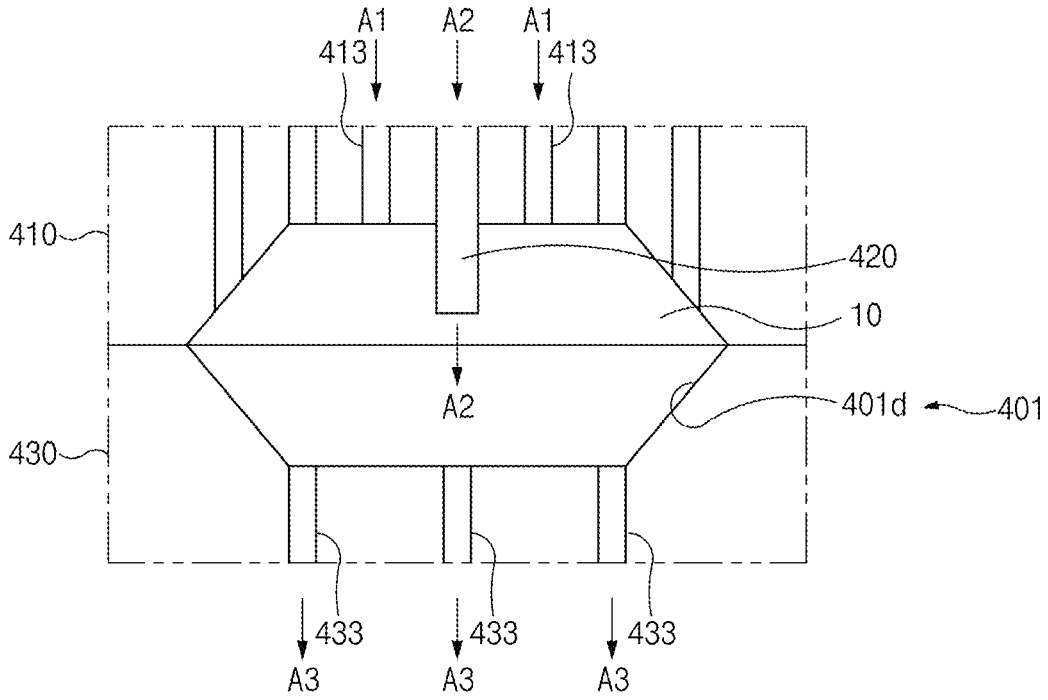
FIG. 5 is an enlarged view illustrating a state in which a blow pin applied to the present disclosure is mounted.

Referring to FIGS. 4 and 5, the core manufacturing apparatus 100 of the present disclosure may further include a hot-air supply device 600. The hot-air supply device 600 may supply hot air into the mold 400 to solidify the mulling sand introduced into the mold 400. The solidified cores 10 may be ejected by an ejector 700 placed below the mold 400. A cavity 401*d* having a different form from the cavities 401*a*, 401*b*, and 401*c* illustrated in FIG. 2 is illustrated in FIG. 4. However, the hot-air supply device 600 and a blow pin 420, which will be described below, are not restrictively applied to the cavity 401*d* in the shape illustrated in FIG. 4, but may be applied to all the cavities 401 formed in the mold 400.

The mold 400 may further include blow holes 413 and the blow pin 420. The blow holes 413 may be formed through the upper mold 410 to connect to the cavity 401*d* and may inject the hot air from the hot-air supply device 600 into the mulling sand deposited in the cavity 401*d*. The blow pin 420 may be formed in a hollow shape. The blow pin 420 may be inserted through the upper mold 410 to extend to the central portion of the cavity 401*d* and may inject the supplied hot air into the central portion of the core 10 that is to be solidified.

The blow holes 413 formed through the upper mold 410 may connect a chamber 610 of the hot-air supply device 600 and the cavity 401*d*. Furthermore, the lower mold 430 may have vents 433 through which the injected hot air is released, and a support 450 may support the mold 400. The hot air from the hot-air supply device 600 may be supplied into the mold 400 through the blow holes 413 (refer to A1 in FIG. 5). The supplied hot air may transfer heat to the core 10 that is to be solidified, and may be released through the vents 433 (refer to A2 in FIG. 5).

When the hot air is supplied through only the blow holes 413, the hot air may fail to reach the central portion of the core 10 that is to be solidified because the blow holes 413 are formed outside the cavity 401*d*. As a result, a large amount of time may be taken to solidify the central portion of the core 10, and the quality of the interior of the core 10 may be deteriorated.

To solve this problem, the mold 400 of the present disclosure further includes the blow pin 420. The blow pin 420 may be inserted into the upper mold 410 and may connect the chamber 610 of the hot-air supply device 600 and the cavity 401*d*. The blow pin 420 may be inserted to extend to the central portion of the cavity 401*d*. Accordingly, the hot air may be directly injected into the central portion of the core 10 that is to be solidified (refer to flow A2 in FIG. 5), and thus core sintering time may be reduced, which may lead to a reduction in core manufacturing cycle.

Figure 6:
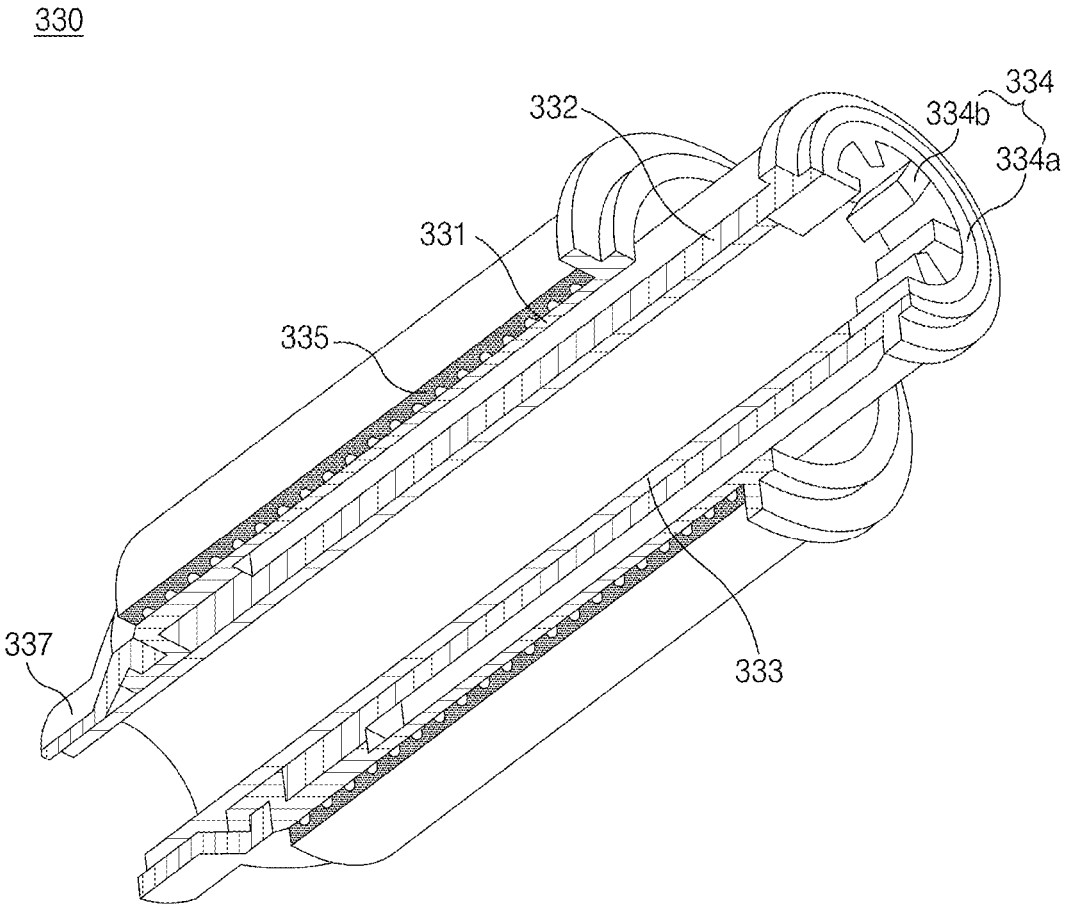
FIG. 6 is a sectional perspective view illustrating a blowing nozzle of the present disclosure.
Figure 8:
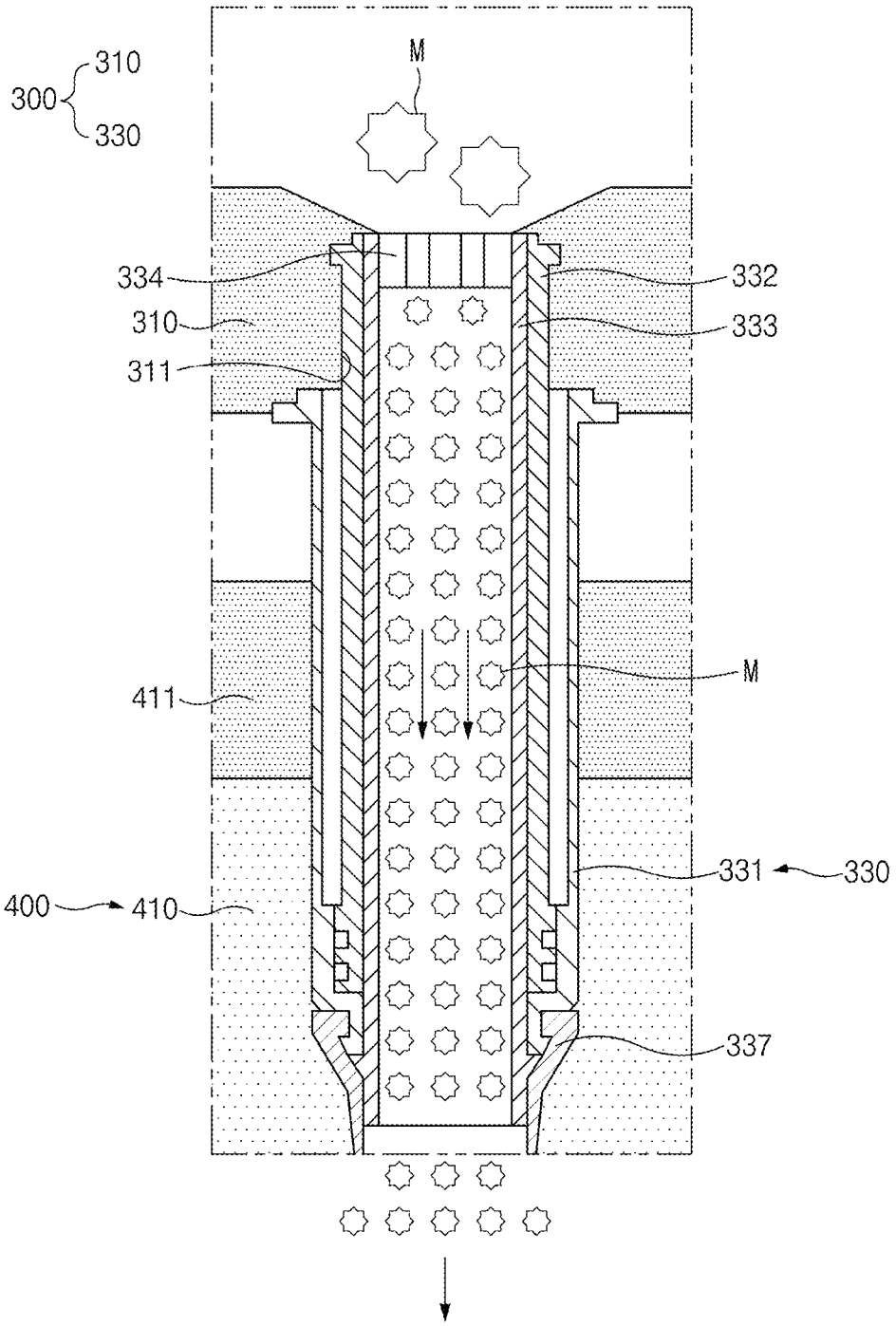
FIG. 8 is a sectional view illustrating a state in which a breaker is installed in the blowing nozzle.

Referring to FIG. 6 and FIG. 8, the core manufacturing apparatus 100 of the present disclosure may further include a blowing device 300. The blowing device 300 may be provided between the mulling sand feeder 200 and the mold 400 to introduce the mulling sand from the mulling sand feeder 200 into the mold 400.

The blowing device 300 includes a blowing plate 310 and a blowing nozzle 330. The blowing plate 310 may be installed over the upper mold 410 and may distribute the mulling sand supplied. The blowing nozzle 330 may blow the supplied mulling sand into the cavity 401*d* and may be installed to penetrate through the blowing plate 310 and the upper mold 410.

Specifically, in one embodiment, the blowing plate 310 may be installed over the mold 400 and may distribute the mulling sand supplied from the mulling sand feeder 200. The blowing plate 310 may have a plurality of through-holes 311 formed therein. The mulling sand may be introduced into the mold 400 through the through-holes 311, and the hot air from the hot-air supply device 600 may be supplied into the mold 400 through the through-holes 311 to solidify the mulling sand. The blowing nozzle 330 may be installed to pass through the through-holes 311, an upper base 411, and the upper mold 410.

Furthermore, the blowing plate 310 may have a cooling line 312 through which cooling water flows. When the mulling sand is introduced, the cooling water flowing through the cooling line 312 may prevent sintering of the mulling sand introduced through the blowing nozzle 330. A sealing member 320 may be provided between the blowing plate 310 and the upper base 411 of the mold 400 to form a seal between the blowing plate 310 and the mold 400.

Specifically, the blowing nozzle 330 may include a nozzle body 331, a nozzle pipe 332, and a breaker 334.

The nozzle body 331 may be installed to pass through the upper mold 410 and may be formed in a cylindrical shape having an empty space inside. The nozzle pipe 332 may be inserted into the nozzle body 331, and the mulling sand may pass through the nozzle pipe 332. A shooting pipe 333 may be fit into the nozzle pipe 332. In this case, the mulling sand M may be introduced into the mold 400 through the shooting pipe 333. Furthermore, a blower rubber 337 may be coupled to a lower end portion of the nozzle body 331.

The breaker 334 may be provided in the nozzle pipe 332 and may break the mulling sand M that is introduced into the nozzle pipe 332. No special limitation applies to the type and shape of the breaker 334, as long as the breaker 334 is able to be mounted in the nozzle pipe 332 to break the mulling sand M introduced into the nozzle pipe 332.

For example, referring to FIGS. 6 and 8, the breaker 334 may include a body 334*a* and breaking protrusions 334*b*. The body 334*a* may be formed in a ring shape that is fit into an upper end portion of the nozzle pipe 332. The breaking protrusions 334*b* may protrude from the inner circumferential surface of the body 334*a* to break the mulling sand M introduced.

Figure 7:
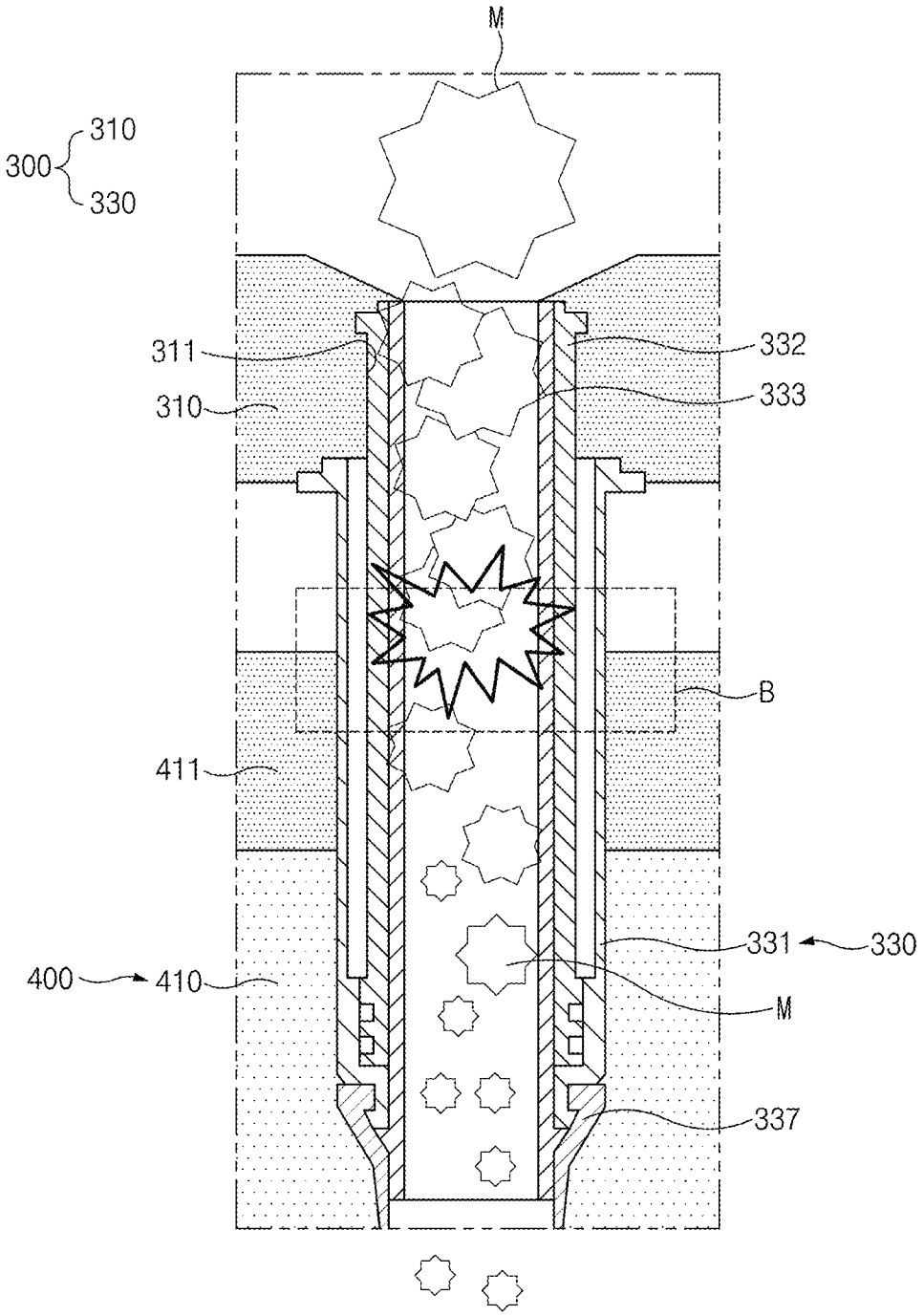
FIG. 7 is a sectional view illustrating a case in which no breaker is installed in the blowing nozzle.

Specifically, referring to FIG. 7, the blowing nozzle 330 may be clogged in the case where a large amount of sand (sand) is introduced to manufacture a large outer core or faulty mulling sand M is introduced. As a result, the fluidity of the mulling sand M introduced into the blowing nozzle 330 may be deteriorated so that the shape of a deep portion of the large core may not be as designed. In addition, due to the clogging of the blowing nozzle 330, the mold 400 may not be appropriately filled with the mulling sand M. Consequently, the quality of the core may be deteriorated.

Referring to FIG. 8, the present disclosure may address the problem by using the breaker 334 provided in the blowing nozzle 330. The breaker 334 may break mulling sand M including faulty mulling sand M introduced into the blowing nozzle 330, thereby making the size of the mulling sand M uniform, which in turn improves the fluidity of the introduced mulling sand M. Accordingly, even in the case of forming a large outer core, the present disclosure may prevent deterioration in the quality of the core, thereby ensuring uniform quality of the core.

Figure 9:
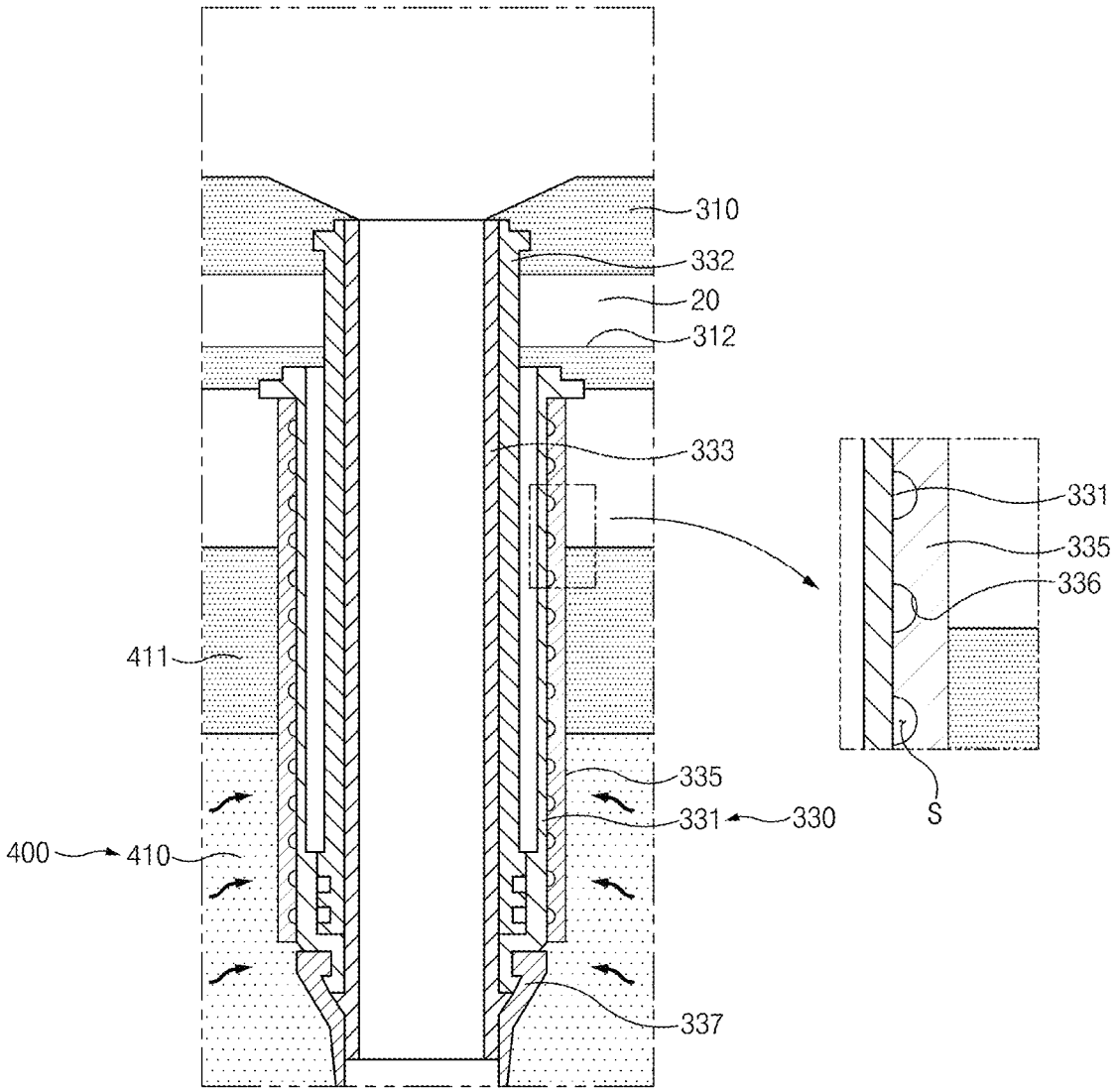
FIG. 9 is a sectional view illustrating a state in which a heat insulation member is installed in the blowing nozzle according to the present disclosure.

Referring to FIGS. 6 and 9, the blowing nozzle 330 may further include a cover member 335. To minimize heat loss from the mold 400, the cover member 335 may cover the outer circumferential surface of the nozzle body 331 and may be formed of a heat insulating material.

Furthermore, the cover member 335 may have heat insulation spaces S on the inner circumferential surface thereof that makes contact with the nozzle body 331. For example, the cover member 335 may include a plurality of heat insulation grooves 336 concavely formed on the inner circumferential surface of the cover member 335 that makes contact with the nozzle body 331. The heat insulation grooves 336 may form the heat insulation spaces S. However, the heat insulation spaces S formed on the inner circumferential surface of the cover member 335 are not limited to the heat insulation grooves 336, and various changes and modifications can be made.

Specifically, as described above, the cooling line 312 through which the cooling water flows may be formed in the blowing plate 310. When the mulling sand M is introduced, heat from the mold 400 may be prevented from being transferred to the mulling sand M, by cooling the blowing nozzle 330 using the cooling water flowing through the cooling line 312.

However, the capacity of cooling water may be insufficient because the blowing nozzle 330 and the mold 400 make contact with each other for a long period of time in the case where a large amount of sand (sand) is introduced to manufacture a large outer core. As a result, the heat of the preheated mold 400 may be transferred to the blowing nozzle 330 and the mulling sand M, and therefore the mulling sand M in the blowing nozzle 330 may be sintered to clog the blowing nozzle 330 (refer to B of FIG. 7).

The present disclosure may minimize heat transfer from the mold 400 to the blowing nozzle 330 by covering the outer circumferential surface of the nozzle body 331 with the cover member 335 made of a heat insulating material and forming the heat insulation spaces S between the cover member 335 and the nozzle body 331. Thus, the fluidity of the mulling sand M introduced through the blowing nozzle 330 may be improved. Accordingly, even in the case of manufacturing a large outer core, uniform fluidity may be ensured, which results in an improvement in the quality of the core.

As described above, the core manufacturing apparatus using the inorganic binder according to the present disclosure includes the second heater implemented as separate from the first heater outside the mold, thereby uniformly maintaining the temperatures of the plurality of cavities in the mold, which in turn improves the productivity of the cores.

In addition, according to the present disclosure, the core manufacturing apparatus directly injects the hot air into the central portion of the core that is to be solidified, thereby reducing core sintering time, which in turn reduces core manufacturing cycle.

According to the present disclosure, the core manufacturing apparatus using the inorganic binder reheats the fluid that is introduced into the mold after being heated outside, by using the second heater implemented as separate from the first heater outside the mold, thereby uniformly maintaining the temperatures of the plurality of cavities in the mold, which in turn improves the productivity of the cores.

Furthermore, according to the present disclosure, the core manufacturing apparatus directly injects the hot air into the central portion of the core that is to be solidified, thereby reducing core sintering time, which in turn reduces core manufacturing cycle.

In addition, according to the present disclosure, in the case of manufacturing the large outer core using the inorganic binder, the core manufacturing apparatus reduces the elapsed time, thereby ensuring the productivity of the core and improves the fluidity of the introduced mulling sand, thereby improving the quality of the core.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A core manufacturing apparatus using an inorganic binder, the apparatus comprising:

a mulling sand feeder configured to supply mulling sand prepared by mulling sand and the inorganic binder;

a mold configured to receive the mulling sand from the mulling sand feeder and to mold the mulling sand into a core, wherein the mold includes an upper mold and a lower mold and has a plurality of cavities disposed therein in which the mulling sand is deposited, and the mold further includes an inner fluid channel through which fluid flows;

a mold heating device configured to heat the mold; and a hot-air supply device configured to supply hot air into the mold to solidify the mulling sand deposited into the mold, wherein the mold heating device includes:

a heating line disposed outside the mold, wherein the heating line connects to the inner fluid channel to allow the fluid to flow in or out of the inner fluid channel and to circulate the fluid throughout the inner fluid channel;

a first heater connected to the heating line, wherein the first heater is configured to heat the fluid that is released from the mold to the heating line and then introduced into the mold again; and a second heater disposed inside the mold so as to be adjacent to an intermediate position of the inner fluid channel, wherein the second heater is configured to heat the fluid flowing through the inner fluid channel, wherein the mold further includes:

a blow hole penetrating through the upper mold to connect to the cavities such that the hot air from the hot-air supply device is injected into the mulling sand deposited in the cavities through the blow hole; and a hollow blow pin inserted through the upper mold to extend to a central portion of each cavity, wherein the blow pin is configured to inject the hot air into a central portion of the core such that the core is solidified.

2. The core manufacturing apparatus of claim 1, wherein the inner fluid channel is disposed around areas in which the plurality of cavities are located, to transfer heat to the plurality of cavities, and wherein the second heater is disposed in at least one position between the plurality of cavities and transfers heat to the inner fluid channel.

3. The core manufacturing apparatus of claim 1, wherein the mold heating device further includes:

a first controller configured to obtain temperature of the fluid released from the inner fluid channel to the heating line and control the first heater based on the obtained temperature to heat the fluid introduced into the inner fluid channel again to a preset temperature; and a second controller configured to control the second heater to adjust temperature of the fluid, which passes through an internal point adjacent to the second heater, to reach a preset temperature, based on temperature measured by a temperature sensor configured to measure the temperature of the internal point adjacent to the second heater.

4. The core manufacturing apparatus of claim 1, further comprising:

a blowing device provided between the mulling sand feeder and the mold to introduce the mulling sand from the mulling sand feeder into the mold, wherein the blowing device includes:

a blowing plate installed over the upper mold and configured to distribute the mulling sand to the mold; and a blowing nozzle penetrating through the blowing plate and the upper mold, wherein the blowing nozzle is configured to blow the mulling sand into the cavities.

5. The core manufacturing apparatus of claim 4, wherein the blowing nozzle includes:

a cylindrical nozzle body configured to penetrate through the upper mold;

a nozzle pipe inserted into the cylindrical nozzle body such that the mulling sand passes through the nozzle pipe; and a breaker disposed in the nozzle pipe and configured to break the mulling sand introduced into the nozzle pipe.

6. The core manufacturing apparatus of claim 5, wherein the breaker includes:

a ring-shaped body fit into an upper end portion of the nozzle pipe; and a breaking protrusion protruding from an inner circumferential surface of the body to break the mulling sand introduced.

7. The core manufacturing apparatus of claim 5, wherein the blowing nozzle further includes a cover member configured to cover an outer circumferential surface of the nozzle body to minimize heat loss from the mold, wherein the cover member comprises a heat insulating material.

8. The core manufacturing apparatus of claim 7, wherein the cover member comprises a heat insulation space on an inner circumferential surface thereof, wherein the heat insulating space is in contact with the nozzle body.

9. The core manufacturing apparatus of claim 7, wherein the cover member includes a plurality of heat insulation grooves concavely formed on an inner circumferential surface thereof, wherein the heat insulating grooves is in contact with the nozzle body.

* * * * *